US008057364B2

(12) United States Patent
Goldberg

(10) Patent No.: US 8,057,364 B2
(45) **Date of Patent: *Nov. 15, 2011**

(54) STATIONARY EXERCISE BICYCLE

(75) Inventor: Johnny Goldberg, Los Angeles, CA (US)

(73) Assignee: Mad Dogg Athletics, Inc., Venice, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/157,607

(22) Filed: Jun. 10, 2008

(65) Prior Publication Data

US 2009/0082177 A1 Mar. 26, 2009

Related U.S. Application Data

(63) Continuation of application No. 11/065,336, filed on Feb. 23, 2005, now Pat. No. 7,455,627, which is a continuation of application No. 10/086,662, filed on Feb. 28, 2002, now Pat. No. 6,881,178, which is a continuation of application No. 09/672,179, filed on Sep. 27, 2000, now Pat. No. 6,488,280, which is a continuation of application No. 09/019,352, filed on Feb. 5, 1998, now Pat. No. 6,155,958, which is a continuation of application No. 08/736,976, filed on Oct. 25, 1996, now Pat. No. 5,722,916, which is a continuation of application No. 08/391,438, filed on Feb. 21, 1995, now abandoned, which is a continuation of application No. 07/969,765, filed on Oct. 30, 1992, now Pat. No. 5,423,728.

(51) Int. Cl.
*A63B 21/00* (2006.01)
*A63B 22/06* (2006.01)

(52) U.S. Cl. ..... 482/57; 482/63
(58) Field of Classification Search ..... 482/57–63
See application file for complete search history.

(56) References Cited

U.S. PATENT DOCUMENTS

| | | | |
|---|---|---|---|
| 562,198 | A | 6/1896 | Robinson |
| 588,166 | A | 8/1897 | McCoy |
| 633,534 | A | 9/1899 | Read |
| 635,082 | A | 10/1899 | Stiles |
| 671,785 | A | 4/1901 | Young et al. |
| 1,336,774 | A | 4/1920 | Cooper |
| 1,507,554 | A | 9/1924 | Cooper |
| 1,636,327 | A | 7/1927 | Roe |
| 3,062,204 | A | 11/1962 | Stefano |

(Continued)

FOREIGN PATENT DOCUMENTS

AU B-22925/83 6/1984

(Continued)

OTHER PUBLICATIONS

PCT International Search Report dated Jul. 14, 1995, International Application No. PCT US/95/03878.

(Continued)

*Primary Examiner* — Stephen Crow
(74) *Attorney, Agent, or Firm* — Jones Day

(57) ABSTRACT

A novel stationary exercise bicycle and method for exercising on that bicycle is disclosed. The novel bicycle, comprising a frame having front and rear sockets, a seat mounted into the rear socket, and a handlebar mounted in the front socket, can advantageously be adjusted so that a rider can adopt different riding positions to simulate outdoor bicycle riding conditions.

17 Claims, 5 Drawing Sheets

U.S. PATENT DOCUMENTS

| | | | | |
|---|---|---|---|---|
| 3,511,097 | A | | 5/1970 | Corwin |
| D251,747 | S | | 5/1979 | Valentine et al. |
| 4,188,030 | A | | 2/1980 | Hooper |
| 4,296,940 | A | | 10/1981 | Herbert |
| 4,477,072 | A | | 10/1984 | DeCloux |
| D280,117 | S | | 8/1985 | Collins |
| D280,118 | S | | 8/1985 | Collins |
| 4,577,860 | A | | 3/1986 | Matias |
| D284,596 | S | | 7/1986 | McNeil |
| 4,632,386 | A | | 12/1986 | Beech |
| D289,782 | S | | 5/1987 | Szymski et al. |
| D291,462 | S | | 8/1987 | Aalto |
| D292,304 | S | | 10/1987 | Ostrom |
| 4,768,777 | A | | 9/1988 | Yang |
| 4,772,069 | A | | 9/1988 | Szymski |
| D299,732 | S | | 2/1989 | Gustafsson |
| 4,824,102 | A | | 4/1989 | Lo |
| 4,880,225 | A | | 11/1989 | Lucas et al. |
| 4,902,001 | A | | 2/1990 | Balbo |
| 4,915,374 | A | | 4/1990 | Watkins |
| 4,936,570 | A | | 6/1990 | Szymski et al. |
| 4,938,475 | A | | 7/1990 | Sargeant et al. |
| 5,000,469 | A | | 3/1991 | Smith |
| 5,145,477 | A | | 9/1992 | Han |
| 5,154,095 | A | | 10/1992 | Giard, Jr. |
| 5,199,324 | A | | 4/1993 | Sain |
| 5,232,422 | A | | 8/1993 | Bishop, Jr. |
| 5,336,147 | A | | 8/1994 | Sweeney, III |
| 5,423,728 | A | | 6/1995 | Goldberg |
| 5,722,916 | A | * | 3/1998 | Goldberg ..... 482/57 |
| 6,155,958 | A | * | 12/2000 | Goldberg ..... 482/57 |
| 6,468,185 | B1 | * | 10/2002 | Goldberg ..... 482/57 |
| 6,793,608 | B2 | | 9/2004 | Goldberg |
| 6,881,178 | B1 | * | 4/2005 | Goldberg ..... 482/57 |
| 7,455,627 | B2 | * | 11/2008 | Goldberg ..... 482/57 |

FOREIGN PATENT DOCUMENTS

| | | |
|---|---|---|
| FR | 779363 | 4/1935 |

OTHER PUBLICATIONS

Pan'S World International, Ltd., Fitness Range from Pan's World, Taipei, Taiwan, R.O.C., 1984, 12 pages.

Nautilus, Inc., Request for Ex Parte Reexamination of U.S. Patent No. 6,468,185, U.S. Appl. No. 90/010,829, filed Jan. 15, 2010, 298 pages.

Nautilus, Inc., Request for Ex Parte Reexamination of U.S. Patent No. 6,793,608, U.S. Appl. No. 90/010,855, filed Feb. 9, 2010, 351 pages.

Bicycling magazine cover, Nov. 1989, 1 page.

* cited by examiner

STATIONARY EXERCISE BICYCLE

CROSS REFERENCE TO RELATED APPLICATIONS

This is a continuation of application Ser. No. 11/065,336, filed Feb. 23, 2005, now U.S. Pat. No. 7,455,627, which is a continuation of application Ser. No. 10/086,662, filed Feb. 28, 2002, now U.S. Pat. No. 6,881,178, which is a continuation of application Ser. No. 09/672,179, filed Sep. 27, 2000, now U.S. Pat. No. 6,488,280, which is a continuation of Ser. No. 09/019,352, filed Feb. 5, 1998, now U.S. Pat. No. 6,155,958, which is a continuation of Ser. No. 08/736,976, filed Oct. 25, 1996, now U.S. Pat. No. 5,722,916, which is a continuation of application Ser. No. 08/391,438, filed Feb. 21, 1995, now abandoned, which is a continuation of Ser. No. 07/969,765, filed Oct. 30, 1992, now U.S. Pat. No. 5,423,728.

BACKGROUND

Having a stationary exercise bicycle capable of simulating mountain bike riding is valuable.

This invention relates to a stationary exercise bicycle which is sturdy and comfortable for use during extended periods of pedaling while standing or sitting or a combination thereof and thus capable of meeting the needs of the more demanding rider.

In recent years, the popularity of the stationary exercise bicycle has increased dramatically together with the fitness craze. Stationary exercise bicycles are conventionally made with straight, brazed round tubing. A problem associated with using the round tubing in these bicycles is their propensity for fragility. They easily snap under increased stress, for example, during periods when the rider is pedaling in a standing position or in an alternating standing and sitting pedaling position. Also, the bicycle structure does not provide for the best flexibility according to the preferences of the rider.

There is a need to provide a stationary exercise bicycle which is more durable and overcomes the problems of the prior art.

SUMMARY

The invented stationary exercise bicycle seeks to avoid the disadvantages associated with conventional stationary exercise bicycles.

According to the invention, the stationary exercise bicycle comprises a stable frame. Additionally, the frame comprises a front socket and a rear socket, and front and rear ground support elements. Also provided is a pedal mechanism on said frame.

Also, the bicycle comprises a detachable seat socket. A seat is mounted on a seat socket at a level above the pedal mechanism. The seat is mounted for movement fore and aft relative to the seat socket and upwardly and downwardly relative to the pedal mechanism.

Additionally, the stationary exercise bicycle comprises a handlebar mounted in the front socket. The handlebar includes at least two different handle means. One handle means includes spaced apart and outwardly directed elements. The second handle means includes an element inwardly located relative to the first handle means. The handlebar is adjustable in the front socket.

Further, in one preferred form, the frame comprises at least multiple upstanding posts. The posts are inter-engaging to form at least one triangulated or V-shaped structure between the ground support elements and one of the sockets.

Additionally, at least part of the front socket, rear socket, or seat socket are formed with a hollow member having a cross-section which is non-cylindrical.

The pedal mechanism may include a cog operative with an endless chain having slots for engagement with the cog. A ring guard is provided and protective of at least the interaction of the teeth of the cog with the endless chain. The ring guard is located internally of the perimeter defined by the endless chain.

The invented stationary exercise bicycle is strong and comfortable for the rider. The adjustability of the bicycle facilitates comfortable riding of the bicycle in multiple positions, for example, sitting, standing and different gripping positions. Moreover, it is stress-resistant so that it can be used by the rider in a standing position or in an alternating standing and sitting pedaling position for extended periods. Riders of this bicycle can simulate the aerobic effect of mountain bike racing.

According to another aspect of the invention, a method of exercising on the stationary exercise bicycle comprises adjusting the height and the fore and aft position of the seat and optionally also adjusting the height of the handlebars to facilitate riding the stationary exercise bicycle in multiple positions and then riding the bicycle in multiple positions to simulate different bicycle riding conditions.

Additionally, the invented stationary exercise bicycle is mobile and the parts, easily replaceable. Unlike conventional stationary exercise bicycles, the present invention utilizes regular bicycle components. The user can replace certain parts from conventional bicycle shops and thus service the present invention with conventional bicycle componentry. Further, unlike prior art stationary exercise bicycles, the present invention has four basic parts which are detachable and can be placed in a portable transport carrier for mobility.

The invention is now further described with reference to the accompanying drawings.

DRAWINGS

Figure 6A:
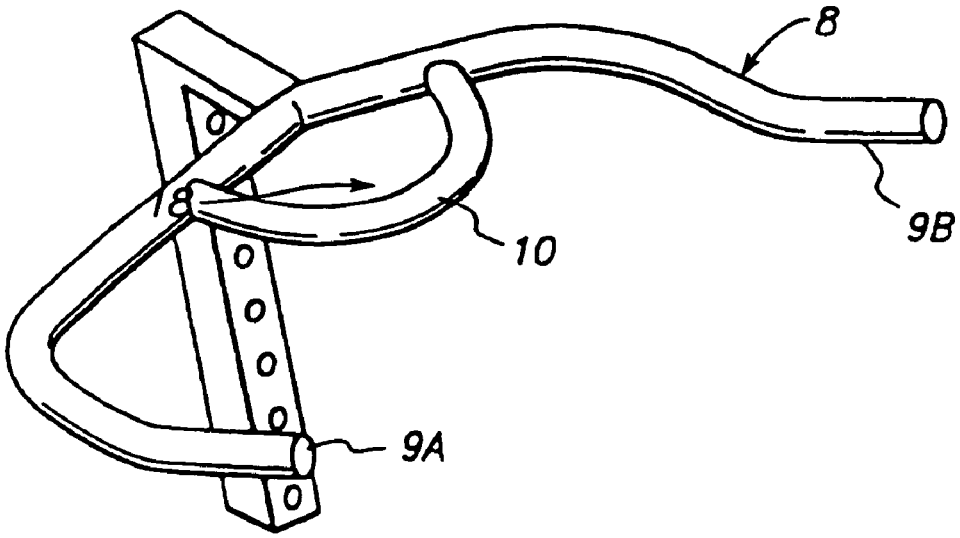
Figure 6B:
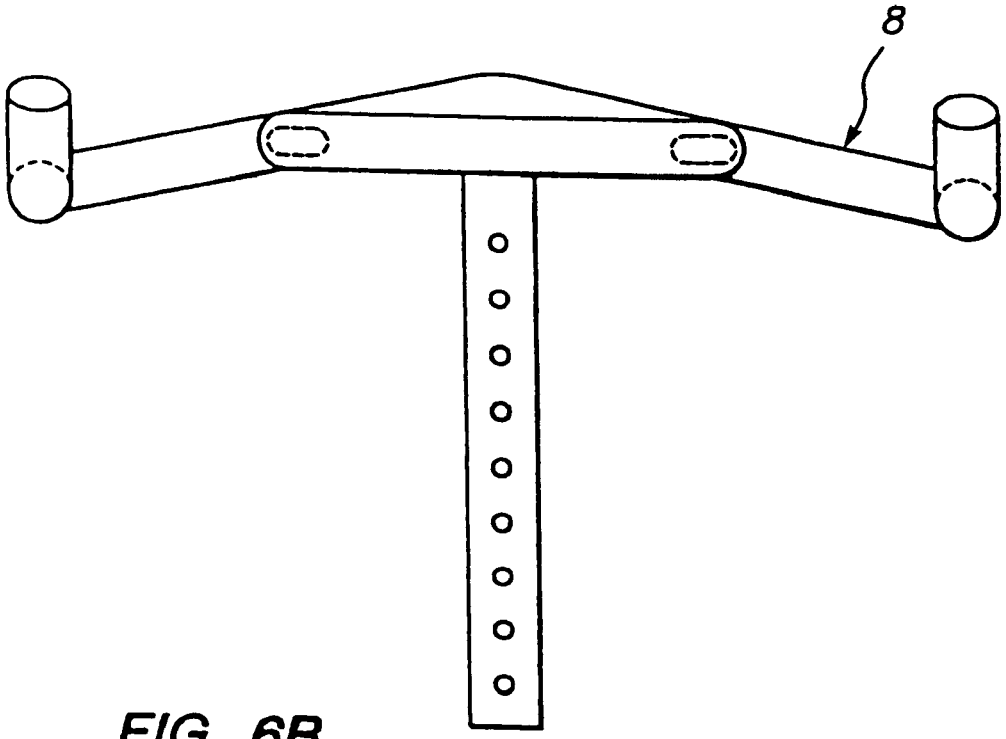
Figure 6C:
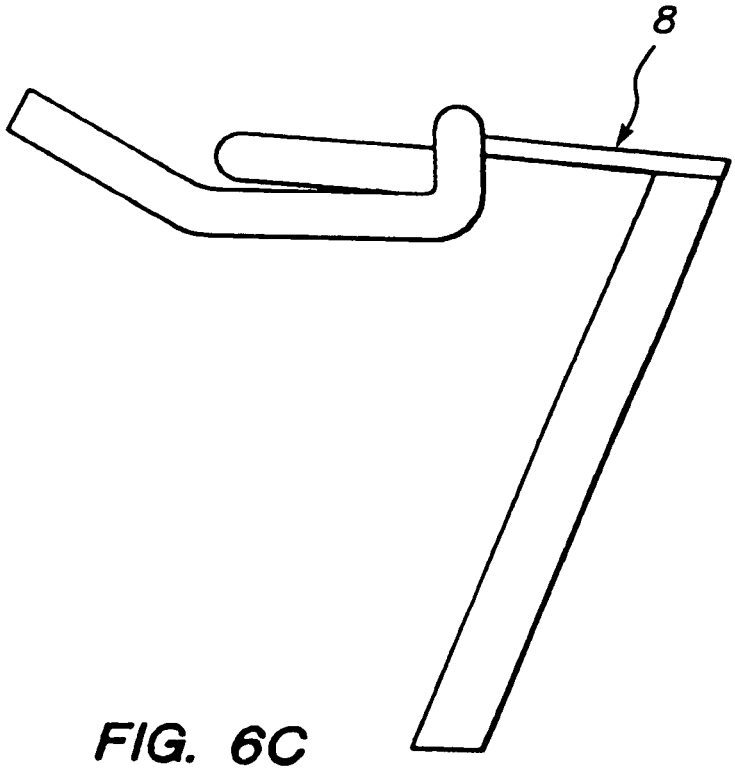
Figure 7:
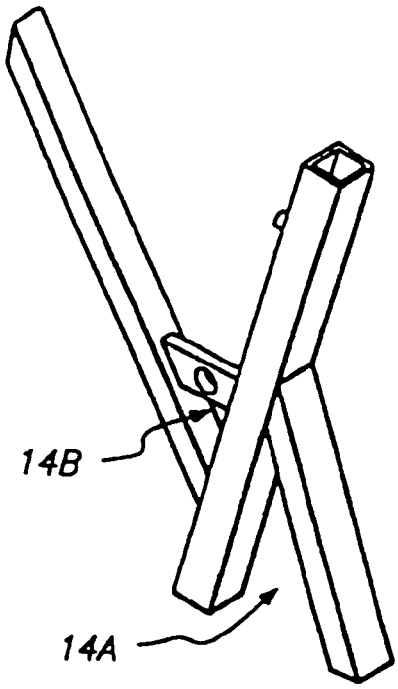
Figure 8:
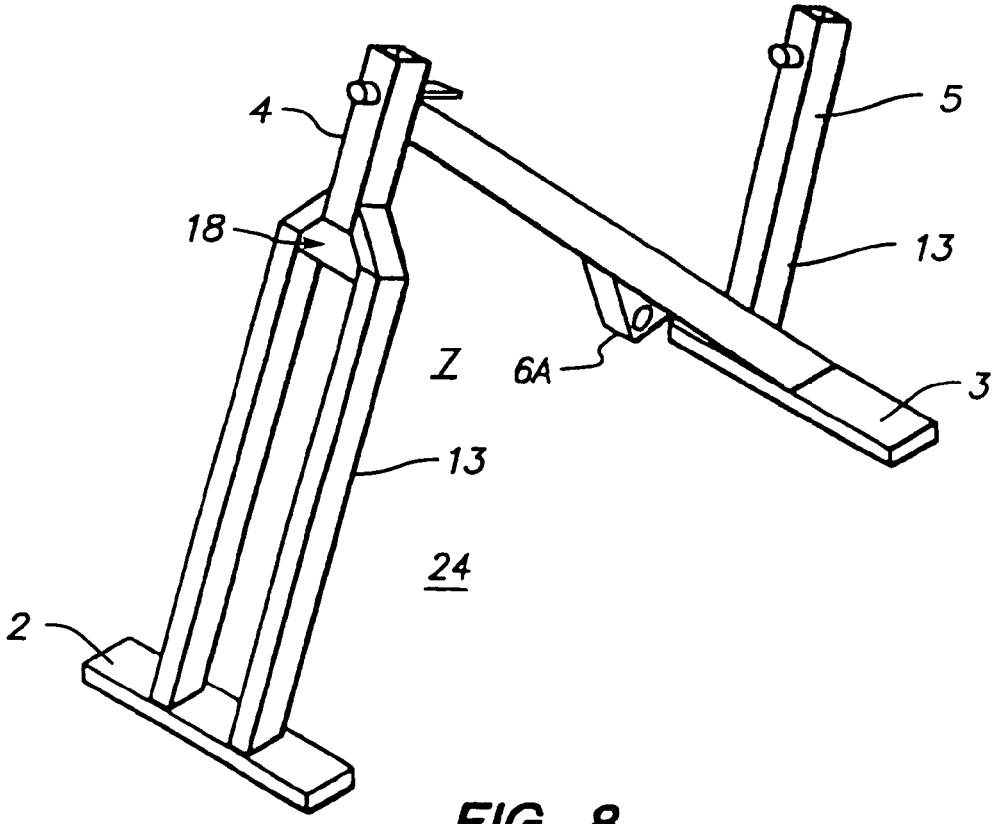

FIGS. 6A, 6B, and 6C are isometric, front and side views, respectively, of the adjustable and detachable handlebar including the forwardly extending prongs, the lateral bar, and the element inwardly located relative to the forwardly extending prongs;

FIG. 7 is an isometric view of the triangulated structure portion of the frame; and FIG. 8 is an isometric view of an alternative frame.

DESCRIPTION

Figure 1:
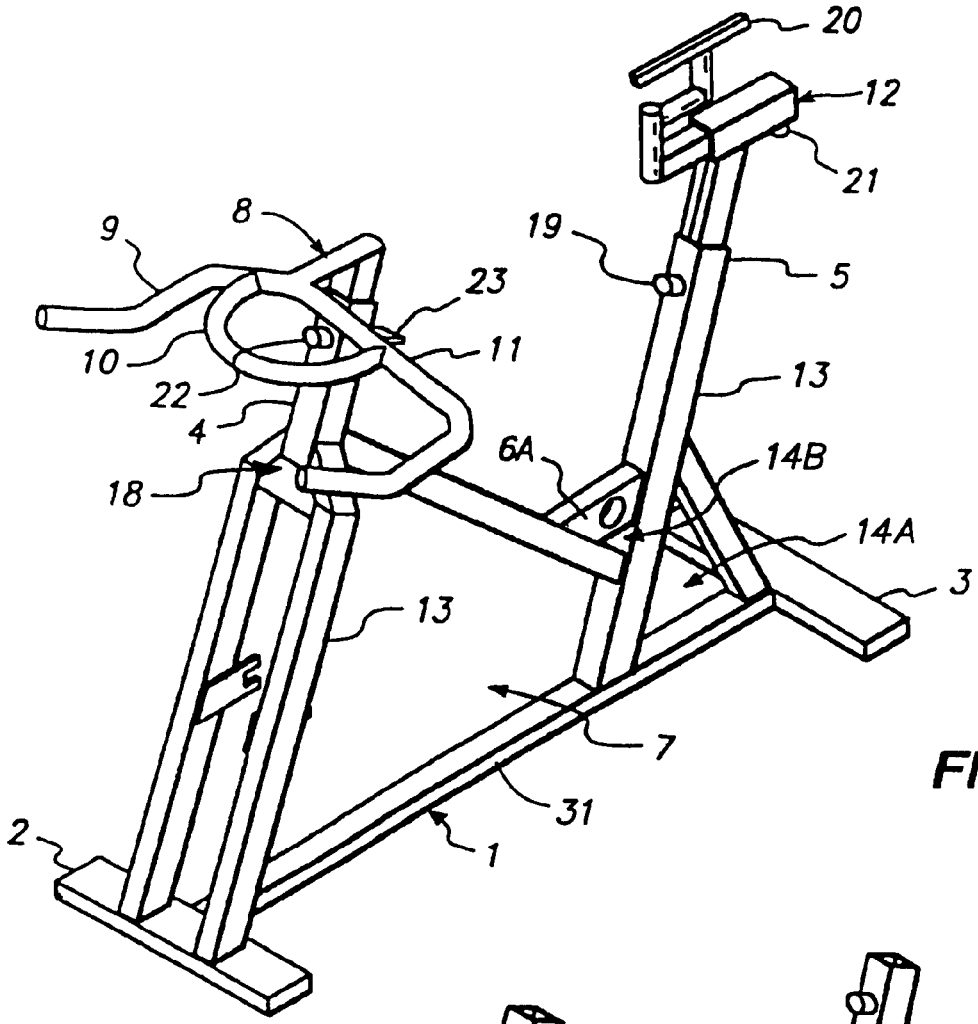
FIG. 1 is an isometric view of a frame for a stationary exercise bicycle.

A stationary exercise bicycle comprises a frame 1 (FIG. 1) or 24 (FIG. 8). The frame has a central ground support element 31, front 2 and rear 3 ground support elements, a front socket 4 and a rear socket 5 and a pedal mechanism 6. As discussed below and as shown in FIG. 1, pedal mechanism 6 generally includes a crankarm and crankset. The rear socket 5 is capable of receiving a seat socket 12. Further, a seat 20 may be mounted on the seat socket 12 at a level above the pedal mechanism 6. The seat 20 is mounted for movement fore and aft relative to the seat socket 12 and upwardly and downwardly relative to the pedal mechanism 6.

This stationary exercise bicycle further comprises a handlebar 8 mounted in the front socket 4. The handlebar 8 includes at least two different handle means 9 and 10. One handle means includes spaced apart and outwardly directed elements 9. The second handle means includes an element inwardly located 10 relative to the first handle means.

The outwardly directed handle means 9 have forwardly extending prongs 9A and 9B (FIG. 6A) which are directed axially away from the seat socket 12. The axially directed prongs 9A and 9B are connected with a lateral bar 11 of the handlebar 8 at one end and are free at an opposite end.

The inner handle means 10 is at least part of a closed ring. The ring is located between the outer handle prongs. Further, the ring is connected to a lateral bar 11 of the handlebar 8.

The closed ring may be a semi-circle. The axis for the semi-circle is located substantially about midway through the lateral bar 11 of the handlebar 8.

The handlebars have been designed with the user's handlebar position needs in mind. Because of the need for the different hand positions during the ride, the ring allows for different hand positions, movements, quick transition from sitting to standing, and standing back to sitting. It also allows, without the use of an attached arm pad, the ability to lie the forearm on the ring portion of the handlebar and simulate a real training cycling position.

The handlebar 8 may be connected to the frame 1 by the front socket 4. A handlebar pop pin 22 permits adjustment of the handlebar 8 according to the requirements of the rider. FIGS. 6A and 6B show the holes which permit the connecting member to be arrestable by a pop pin for adjustment.

Applicant contemplates that alternative handlebars may be connected to the frame 1 or 24 in accordance with the rider's needs.

The frame 1 (FIG. 1) or 24 (FIG. 8) further comprises at least multiple upstanding posts 13. In a preferred form, the posts inter-engage to form at least one triangulated structure 14 between the ground support elements 2 or 3 and one of the sockets.

The frame 1 includes at least two triangulated structures 7 and 14 between the sockets 4, 5, and 12. The two triangulated structures 7 and 14 have at least one common upstanding post 13 forming at least one wall of the triangulated structures 7 and 14. One of the triangulated structures 7 and 14 includes an arm or cross-element 6A intended to mount the pedal mechanism 6.

The upstanding posts 13 form part of the triangulated structure 7 and 14. Moreover, the upstanding posts 13 are all located at a non-horizontal, non-vertical axis.

The triangulated structures 7 and 14 include the rear triangle 14A which includes an inverted V-shaped section and which functions to stabilize the frame 1; the bottom bracket triangle 14B which includes an upstanding V-shaped section and which functions to stabilize the frame 1 so a rider can pedal standing; the front triangle-like structure 7 which functions to permit total range of motion; and a front fork triangle 18.

The rear triangle 14A is important as a stabilizing block. Unlike conventional stationary exercise bicycles, the small base of this triangle gives the bike its total rigidity in the rear.

The bottom bracket triangle 14B gives the central part of the stationary exercise bicycle its rigidity and form for standing. Further, arm or cross-element 6A allows for conventional pedal mechanisms (i.e., crankarm and crankset) be used with a conventional clipless pedal or a regular bicycle pedal and toe clip.

Figure 2:
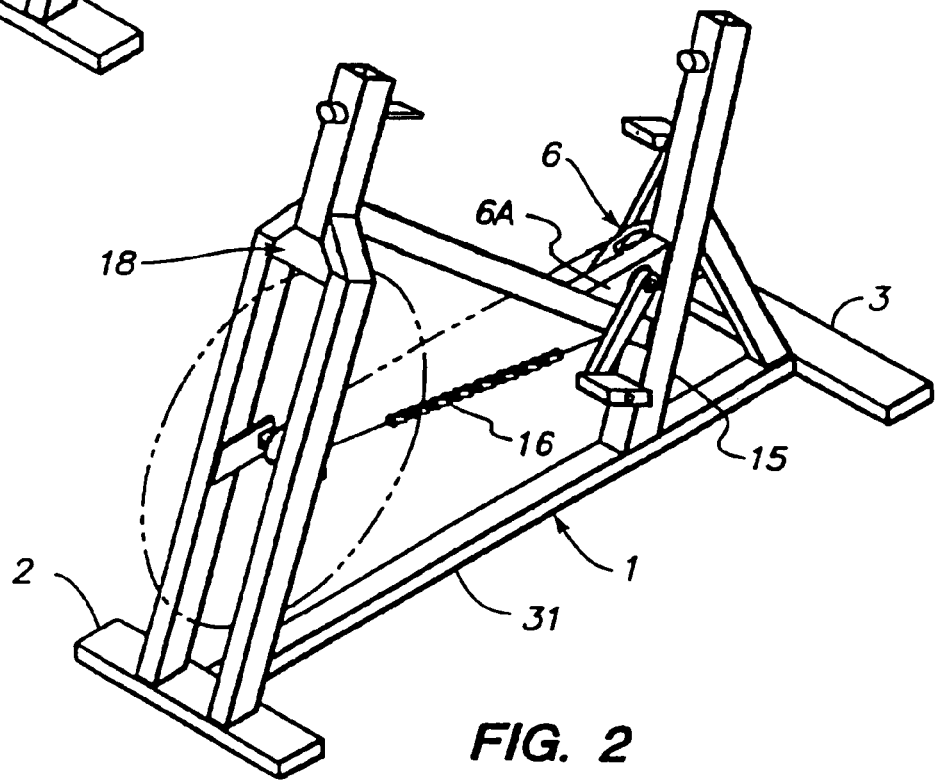
FIG. 2 is an isometric view of the pedal mechanism and a flywheel, both shown in phantom, including the ring guard, cog, and endless chain.

The front triangle-like structure 7 is wide enough to house a flywheel (FIG. 2). The front triangle-like structure 7 gives the stationary exercise bicycle its total range of motion moving the flywheel in and out and giving the stationary exercise bicycle its base length or reel length from foot position to foot position.

The flywheel is connected to the frame 1 or 24 by the front fork triangle 18.

Further, at least part of the front socket 4, rear socket 5, or seat socket 12 are formed with a hollow member having a cross section being non-cylindrical. The sockets described herein permit a matingly shaped connecting member (such as the handlebar 8, the adjustable and detachable seat 20) the connecting member being arrestable by a pop pin 19, 21, 22.

The hollow member may have a polygonal cross section (preferably quadratic). For example, in the illustrated example, the polygonal cross section is substantially square.

The seat is adjustable for height and connected to the seat socket 12. The seat post pop pin 19 permits height adjustment of the seat. The fore and aft saddle pop pin 21 permits adjustment of the seat 20 by sliding fore and aft in the seat socket 12.

Because of the adjustability of the seat and the handlebar, a rider theoretically may be as tall as 15 feet and weigh up to 900 pounds. The handlebar and seat adjustability provides for a versatile bicycle which can be used by persons of many different physiques, from small, light and short to large, tall and heavy.

Figure 3:
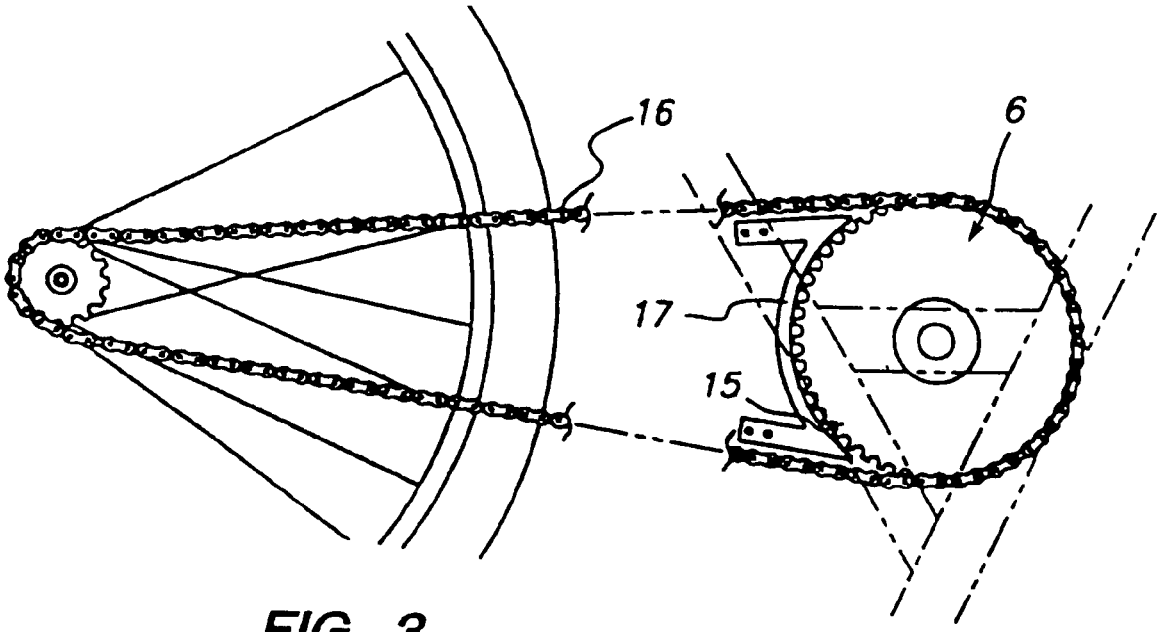
FIG. 3 is a detailed view of the ring guard in relation to the cog and frame.
Figure 4:
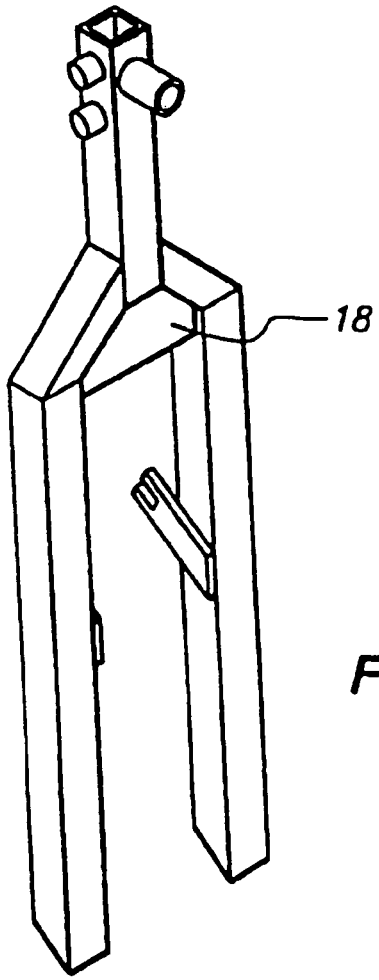
FIG. 4 is an isometric view of the front fork triangle and an upstanding post.
Figure 5:
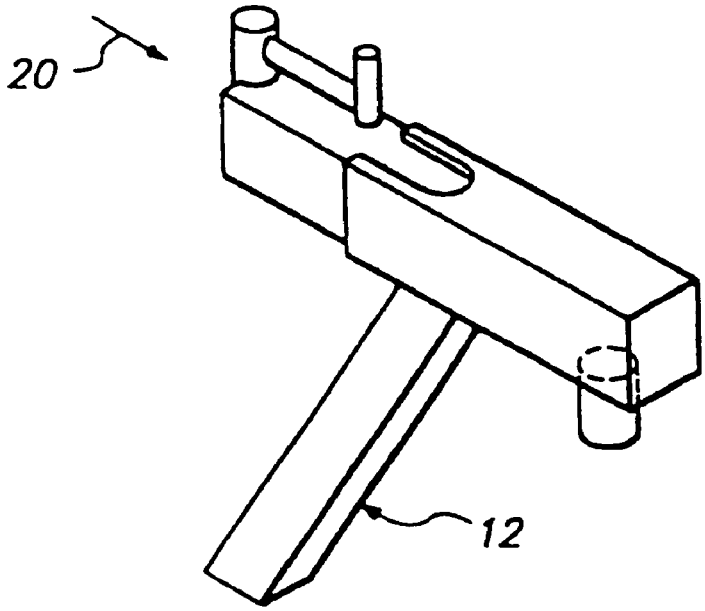
FIG. 5 is an isometric view of the seat socket and the connective member.

Referring now to FIG. 3, the pedal mechanism 6 includes a cog 15 operative with an endless chain 16 having slots for engagement with the cog 15. Additionally, the pedal mechanism 6 includes a ring guard 17 protective of at least the interaction of the teeth of the cog 15 with the endless chain 16. The ring guard 17 is located internally of the perimeter defined by the endless chain 16.

It would be desirable to provide attachments to the present invention. For example, a water bottle may be attached directly to the present invention or indirectly by means of a velcro device or any carrier means for attaching the water bottle to the stationary exercise bicycle.

Additionally, an ergometer may be attached to the present invention. Also, a computer controlled energy measuring and indicating device may be attached to the present invention.

The stationary exercise bicycle may comprise a dual chain tension device which is adjustable while the rider is in motion. Moreover, the stationary exercise bicycle may comprise a cable resistance braking system which permits the rider to adjust the resistance of the flywheel. A resistance plate 23 may support a cable to the flywheel.

The length and width of the stationary exercise bicycle is appropriate for standing and sitting while pedaling. Additionally, the width is appropriate for pedaling while sitting and for stabilization when the rider pedals while standing and rocking the body from side to side.

In a preferred form, the triangulated structures 14A, 14B, 7 stabilize the stationary exercise bicycle. These triangulated structures form the "integrity" structure of the stationary exercise bicycle.

The symmetry of this machine is very basic. The genius in the present invention is in its simplicity. The present invention simulates road conditions exactly as if the rider is pedaling a conventional, non-stationary bicycle.

Applicant contemplates many other examples of the present invention each differing by detail only. For example, there are many variations of the sockets described herein. The sockets described herein may not only permit a matingly shaped connecting member to fit inside (such as the handlebar 8, the adjustable and detachable seat 20), the connecting member being arrestable by a pop pin 19, 21, or 22. In fact, the matingly shaped connecting member may be a hollow into which the socket fits, e.g., the rear, front, or seat socket.

Additionally, the handlebar 8 may include at least two different handle means. One handle means includes spaced apart and outwardly directed elements 9. The second handle means may include an element (e.g., a closed ring) outwardly located relative to the first handle means.

Further, in one form, the frame may have a plurality of segments. Instead of a single unit, the frame may collapse into several units which permits even greater mobility of the stationary exercise bicycle for transport. Each unit of the frame may be re-assembled using bolts or any other type of well known connecting means.

The above description and drawings are only illustrative. They are not intended to limit in any way the invention as set out in the claims which follow.

The invention claimed is:

1. A stationary exercise bicycle, comprising:

a frame having front and rear sockets;

a pedal assembly mounted to the frame;

a seat adjustably mounted in the rear socket, the seat being adjustable in the fore and aft directions relative to the rear socket;

a flywheel mounted to the frame and coupled to the pedal assembly via a chain thereby forming a dual chain tension device; and a handlebar adjustably mounted in the front socket, the handlebar including at least one handle that provides multiple gripping positions for a rider's hands;

wherein the seat and handlebar are adjustable to facilitate the rider riding the stationary exercise bicycle in multiple positions to simulate different bicycle riding conditions, the multiple positions including, a standing position where the rider's center of gravity is over or in front of the pedal assembly, a sitting position where the rider's center of gravity is behind the pedal assembly, and different gripping positions on the handlebar; and wherein the dual chain tension device facilitates a smooth transition between the sitting and standing positions.

2. The stationary exercise bicycle of claim 1, wherein the handlebar is adjustable relative to the front socket to facilitate riding the stationary exercise bicycle in multiple positions.

3. The stationary exercise bicycle of claim 1, wherein the handlebar includes two handles for the rider to rest his or her hands on.

4. The stationary exercise bicycle of claim 1, wherein the handlebar includes a first gripping position for the rider to grip while riding the bicycle in a seated position, and a second gripping position for the rider to grip while riding the bicycle in a standing position.

5. The stationary exercise bicycle of claim 1, further comprising a device to vary the resistance imparted to the flywheel.

6. The stationary exercise bicycle of claim 1, wherein the handlebar and seat are adjustable relative to the frame so that when the rider grips the handlebar, the rider's torso is bent over while the rider is in a seated position.

7. The stationary exercise bicycle of claim 1, wherein the seat and handlebar are adjustable relative to the frame so that when the rider grips the handlebar, the rider's arms are bent at substantially a 90 degree angle while the rider is in a seated riding position.

8. The stationary exercise bicycle of claim 1, wherein the frame is mounted to a base having a width that maintains the stability of the stationary exercise bicycle.

9. A stationary exercise bicycle, comprising:

a frame with inter-engaging multiple upstanding posts forming at least one triangulated structure;

a pedal assembly mounted to the frame;

a seat adjustably mounted to the frame, the seat being adjustable in the fore and aft directions relative to the frame;

a flywheel mounted to the frame and coupled to the pedal assembly via a chain thereby forming a dual chain tension device; and a handlebar adjustably mounted to the frame, the handlebar including at least one handle that provides multiple gripping positions for a rider's hands;

wherein the seat and handlebar are adjustable to different positions relative to the frame to facilitate riding the stationary exercise bicycle in multiple positions to simulate different bicycle riding conditions, the multiple positions including, a standing position where the rider's center of gravity is over or in front of the pedal assembly, a sitting position where the rider's center of gravity is behind the pedal assembly, and different gripping positions on the handlebar; and wherein the dual chain tension device facilitates a smooth transition between the sitting and standing positions.

10. The stationary exercise bicycle of claim 9, wherein the handlebar includes a first gripping position for the rider to grip while riding the bicycle in a seated position, and a second gripping position for the rider to grip while riding the bicycle in a standing position.

11. The stationary exercise bicycle of claim 9, wherein the frame is mounted to a base having a width that maintains the stability of the stationary exercise bicycle.

12. The stationary exercise bicycle of claim 9, wherein the frame comprises two triangulated structures.

13. A stationary exercise bicycle that is adjustable to allow a rider to adopt different riding positions, the stationary exercise bicycle comprising:

a frame having ground supports;

a seat holding mechanism;

a handlebar holding mechanism;

a frame structure connecting the seat holding mechanism to the handlebar holding mechanism;

wherein the frame structure comprises two V-shaped sections, one V-shaped section comprising two members converging to a point, the other V-shaped section comprising members converging to a different point, wherein the two V-shaped sections overlap along a member, the member including one of the holding mechanisms;

a pedal assembly;

a seat adjustably mounted in the seat holding mechanism, the seat being adjustable in the fore and aft directions relative to the rear socket;

a handlebar adjustably mounted in the handlebar holding mechanism, the handlebar including multiple gripping positions;

wherein the seat is adjustable to different positions relative to the frame structure to facilitate riding the stationary exercise bicycle in multiple positions to simulate different bicycle riding conditions, the multiple positions including, a standing position where the rider's center of gravity is over or in front of the pedal assembly, a sitting position where the rider's center of gravity is behind the pedal assembly, and different gripping positions on the handlebar.

14. The stationary exercise bicycle of claim 13, wherein the handlebar is adjustable relative to the handlebar holding mechanism to facilitate riding the stationary exercise bicycle in multiple positions.

15. The stationary exercise bicycle of claim 13, further comprising a flywheel mounted to the frame and coupled to the pedal assembly via a chain thereby forming a dual chain tension device, wherein the dual chain tension device facilitates the smooth transition between sitting and standing positions.

16. A stationary exercise bicycle, comprising:

a frame having front and rear sockets;

a pedal assembly mounted to the frame;

a seat adjustably mounted in the rear socket, the seat being adjustable in the fore and aft directions relative to the rear socket; and a handlebar adjustably mounted in the front socket, the handlebar including a lateral bar directed outwardly from the front socket, a first handle having at least one prong extending forwardly from said lateral bar, and at least one second handle inwardly located relative to the at least one prong, wherein the seat is adjustable to different positions relative to the rear socket to facilitate riding the stationary exercise bicycle in multiple positions to simulate different bicycle riding conditions, the multiple positions including:

a standing position where the rider's center of gravity is over or in front of the pedal assembly, and a sitting position where the rider's center of gravity is behind the pedal assembly, the handlebar having multiple gripping positions on one or more of the lateral bar, the at least one prong and the at least one second handle; and a flywheel mounted to the frame and coupled to the pedal assembly via a chain thereby forming a dual chain tension device, wherein the dual chain tension device facilitates the smooth transition between sitting and standing positions.

17. The stationary exercise bicycle of claim 16, wherein the handlebar is adjustable relative to the front socket to facilitate riding the stationary exercise bicycle in multiple positions.

* * * * *

US008057364C1

(12) EX PARTE REEXAMINATION CERTIFICATE (9668th)

United States Patent

Goldberg

(10) Number: US 8,057,364 C1

(45) Certificate Issued: *May 17, 2013

(54) STATIONARY EXERCISE BICYCLE

(76) Inventor: Johnny Goldberg, Los Angeles, CA (US)

Reexamination Request:
No. 90/012,196, Mar. 14, 2012

Reexamination Certificate for:

| | |
|---|---|
| Patent No.: | **8,057,364** |
| Issued: | **Nov. 15, 2011** |
| Appl. No.: | **12/157,607** |
| Filed: | **Jun. 10, 2008** |

( * ) Notice: This patent is subject to a terminal disclaimer.

Related U.S. Application Data

(63) Continuation of application No. 11/065,336, filed on Feb. 23, 2005, now Pat. No. 7,455,627, which is a continuation of application No. 10/086,662, filed on Feb. 28, 2002, now Pat. No. 6,881,178, which is a continuation of application No. 09/672,179, filed on Sep. 27, 2000, now Pat. No. 6,488,280, which is a continuation of application No. 09/019,385, filed on Feb. 5, 1998, now Pat. No. 6,155,958, which is a continuation of application No. 08/736,976, filed on Oct. 25, 1996, now Pat. No. 5,722,916, which is a continuation of application No. 08/391,438, filed on Feb. 21, 1995, now abandoned, which is a continuation of application No. 07/969,765, filed on Oct. 30, 1992, now Pat. No. 5,423,728.

(51) Int. Cl.
*A63B 21/00* (2006.01)
*A63B 22/06* (2006.01)

(52) U.S. Cl.
USPC ..... 482/57; 482/63

(58) Field of Classification Search
USPC ..... 482/57–63
See application file for complete search history.

(56) References Cited

To view the complete listing of prior art documents cited during the proceeding for Reexamination Control Number 90/012,196, please refer to the USPTO's public Patent Application Information Retrieval (PAIR) system under the Display References tab.

*Primary Examiner* — Matthew C. Graham

(57) ABSTRACT

A novel stationary exercise bicycle and method for exercising on that bicycle is disclosed. The novel bicycle, comprising a frame having front and rear sockets, a seat mounted into the rear socket, and a handlebar mounted in the front socket, can advantageously be adjusted so that a rider can adopt different riding positions to simulate outdoor bicycle riding conditions.

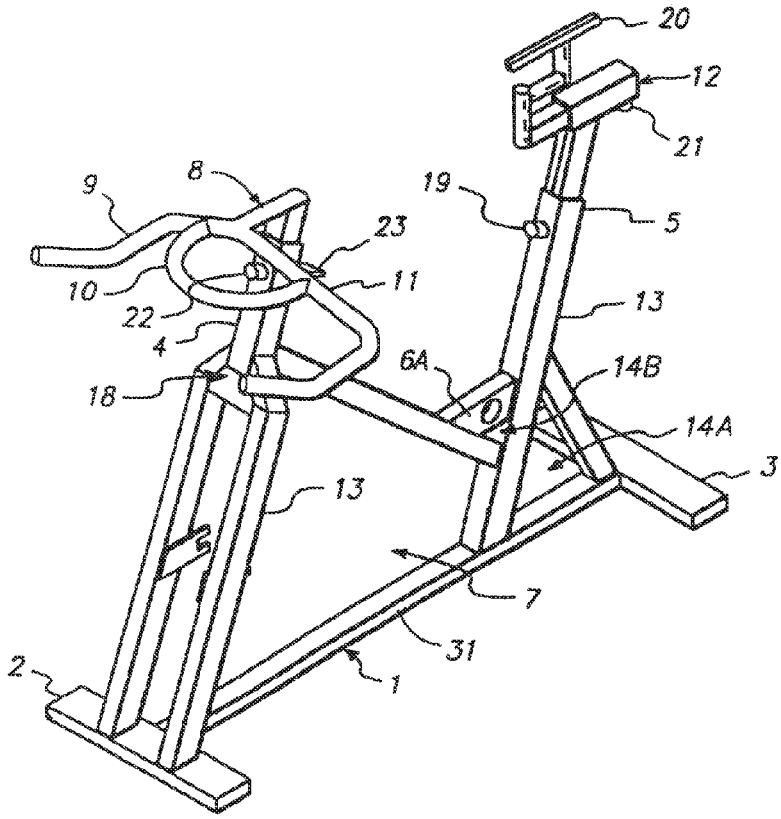

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-12 and 16-17 is confirmed.

Claims 13-14 are cancelled.

Claim 15 is determined to be patentable as amended.

15. [The stationary exercise bicycle of claim 13.] *A stationary exercise bicycle that is adjustable to allow a rider to adopt different riding positions, the stationary exercise bicycle comprising:*

*a frame having ground supports;*

*a seat holding mechanism;*

*a handlebar holding mechanism;*

*a frame structure connecting the seat holding mechanism to the handlebar holding mechanism;*

*wherein the frame structure comprises two V-shaped sections, one V-shaped section comprising two members converging to a point, the other V-shaped section comprising members converging to a different point, wherein the two V-shaped sections overlap along a member, the member including one of the holding mechanisms;*

*a pedal assembly;*

*a seat adjustably mounted in the seat holding mechanism, the seat being adjustable in the fore and aft directions relative to the rear socket;*

*a handlebar adjustably mounted in the handlebar holding mechanism, the handlebar including multiple gripping positions;*

*wherein the seat is adjustable to different positions relative to the frame structure to facilitate riding the stationary exercise bicycle in multiple positions to simulate different bicycle riding conditions, the multiple positions including,*

*a standing position where the rider's center of gravity is over or in front of the pedal assembly,*

*a sitting position where the rider's center of gravity is behind the pedal assembly, and*

*different gripping positions on the handlebar; and*

*the stationary exercise bicycle* further comprising a flywheel mounted to the frame and coupled to the pedal assembly via a chain thereby forming a dual chain tension device, wherein the dual chain tension device facilitates the smooth transition between sitting and standing positions.

* * * * *